US008342883B2

(12) United States Patent
Hoehn et al.

(10) Patent No.: US 8,342,883 B2
(45) Date of Patent: Jan. 1, 2013

(54) ELECTRIC POWER SUPPLY CONNECTING DEVICE FOR A PARAMETERIZABLE ELECTRICAL APPARATUS

(75) Inventors: Claus Hoehn, Altenriet (DE); Dieter Reuker, Stuttgart (DE)

(73) Assignee: BALLUFF GmbH, Neuhausen (DE)

( * ) Notice: Subject to any disclaimer, the term of this patent is extended or adjusted under 35 U.S.C. 154(b) by 59 days.

(21) Appl. No.: 12/800,049

(22) Filed: May 5, 2010

(65) Prior Publication Data

US 2010/0297881 A1 Nov. 25, 2010

(30) Foreign Application Priority Data

May 19, 2009 (DE) ..... 20 2009 007 395 U

(51) Int. Cl.
*H01R 13/66* (2006.01)

(52) U.S. Cl. ..... 439/620.01

(58) Field of Classification Search ..... 439/620.01, 439/595, 638, 676, 501–502
See application file for complete search history.

(56) References Cited

U.S. PATENT DOCUMENTS

| | | | | |
|---|---|---|---|---|
| 6,831,443 | B2 * | 12/2004 | Liu | 320/113 |
| 2003/0080630 | A1 * | 5/2003 | Liu | 307/150 |
| 2004/0087880 | A1 * | 5/2004 | Mason et al. | 601/5 |
| 2004/0169420 | A1 * | 9/2004 | Rendic | 307/38 |
| 2006/0098512 | A1 * | 5/2006 | Tanaka et al. | 365/229 |
| 2006/0292924 | A1 * | 12/2006 | Spiri et al. | 439/535 |
| 2010/0238751 | A1 * | 9/2010 | Dell et al. | 365/226 |
| 2010/0320183 | A1 * | 12/2010 | Borchert et al. | 219/130.1 |

* cited by examiner

*Primary Examiner* — Jean F Duverne
(74) *Attorney, Agent, or Firm* — Lipsitz & McAllister, LLC

(57) ABSTRACT

There is provided an electric power supply connecting device for a parameterizable electrical apparatus, comprising a first connector for an electric power source, a second connector to the electrical apparatus and a storage device for parameter data which can be read out by the electrical apparatus.

19 Claims, 2 Drawing Sheets

ELECTRIC POWER SUPPLY CONNECTING DEVICE FOR A PARAMETERIZABLE ELECTRICAL APPARATUS

This application claims the benefit of German Utility Model Application No. 20 2009 007 395.5 filed on May 19, 2009.

The present disclosure relates to the subject matter disclosed in German Utility Model Application No. 20 2009 007 395.5 of May 19, 2009, which is incorporated herein by reference in its entirety and for all purposes.

BACKGROUND OF THE INVENTION

The invention relates to an electric power supply connecting device for a parameterizable electrical apparatus.

Electrical apparatuses, particularly in systems, often have different operational capabilities which are parameterized. Parameters have to be set for the proper operating condition. These parameters are often stored locally on the electrical apparatuses.

SUMMARY OF THE INVENTION

In accordance with the present invention, an electric power supply connecting device is provided which has extended capabilities of use.

In accordance with an embodiment of the invention, the electric power supply connecting device for a parameterizable electrical apparatus comprises a first connector for an electric power source, a second connector to the electrical apparatus and a storage device for parameter data which can be read out by the electrical apparatus.

An electric power supply connecting device provides for electric power supply to the corresponding electrical apparatus. In particular, it provides for electrical connection to an electric power network. An electric power network connecting device establishes a location-dependent electric connection based on the line routing. A selected electric power supply connecting device thus characterizes a certain location and hence also the associated electrical apparatus.

In the solution in accordance with the invention, the electric power supply connecting device is configured intelligently such that the electrical apparatus can be supplied with parameter data via the electric power supply connecting device. An electrical apparatus at a certain location, for example in a system, can thereby be supplied with the parameter data required for its operation.

Generally, the parameterizing of electrical apparatuses, for example in a system, is carried out only once during initial startup. The corresponding parameter data is normally stored in a non-volatile memory of the electrical apparatus. If a corresponding apparatus in a system fails during operation, a replacement apparatus has to be installed as soon as possible in order to keep downtimes low. However, such a replacement apparatus is usually not properly parameterized.

In the solution in accordance with the invention, the correct parameters for the corresponding electrical apparatus are contained in the associated electric power supply connecting device, which does not have to be replaced when the apparatus is replaced. This allows a replacement apparatus to be parameterized quickly by reading-in the data from the storage device of the electric power supply connecting device.

The appropriate parameters can thereby be read into the corresponding electrical apparatus in a short space of time, enabling downtimes and hence also downtime costs of a system to be minimized.

In particular, the storage device comprises at least one non-volatile memory, such as an EEPROM. This allows parameter data to be permanently stored.

In particular, the first connector is comprised by a plug or is formed by a plug. The electric power supply connecting device can thereby be connected to an electric power network in a simple manner.

For the same reason, it is advantageous if the second connector is comprised by a plug or is formed by a plug. This allows the electric power supply connecting device to be connected to an electrical apparatus in a simple manner and also to be detached from this electrical apparatus in a simple manner when, for example, a replacement apparatus has to be provided.

It is particularly advantageous for the storage device to be arranged on (particularly in) the plug and, in particular, to be integrated in the plug. The plug provides the necessary space for integrating the storage device. Further, data can then be read from the storage device into the associated electrical apparatus in a simple manner. Further, this makes it possible to write data to the storage device of the electric power supply connecting device in a simple manner.

In an embodiment, the storage device is on a carrier (which is, in particular, arranged within an interior of a plug) and is insert-molded. The storage device is thereby arranged in a protected manner.

Advantageously, the storage device has an interface associated with it for reading data from it and/or writing data into it. The storage device can be provided with specific parameter data via the interface, or the electrical apparatus can be provided with parameter data for its parameterization via the interface.

It is advantageous for a third connector to be provided for reading from and/or writing to the storage device. Data exchange with the electrical apparatus is performed via the third connector. This data exchange can be unidirectional. In principle, it is also possible for data to be written to the storage device via the third connector, for example via a separate programming device or even via the electrical apparatus.

In an embodiment, the third connector is integrated in the second connector. This allows the number of components for the electric power supply connecting device to be kept low. With a corresponding configuration of the electrical apparatus and with the electric power supply connecting device connected, it is possible to achieve both electric power supply to the electrical apparatus and operative coupling of the storage device for data exchange with the electrical apparatus.

In an embodiment, the electric power supply connecting device in accordance with the invention is formed as an electric power supply cable with at least one connecting plug. This results in a simple possibility of parameterizing electrical apparatuses, for example in a system, at low production expenditure.

An indicating device can be provided which is associated with the storage device of the electric power supply connecting device. The indicating device, which is for example an optical indicating device, can indicate whether or not data has been written or is being written to a storage device. It is thereby possible, in a simple manner, for a user to recognize whether or not an electric power supply connecting device contains parameter data.

In particular, the electric power supply connecting device is provided for coupling to an electric power network such as a low-voltage power network. In particular, this allows electrical apparatuses, such as identification system evaluation units in a system, to be supplied with electrical energy.

In accordance with the invention, a combination of an electric power supply connecting device and a programming device for writing to the storage device is provided.

By means of the programming device, data can be read into the storage device of the electric power supply connecting device via a corresponding connector which provides mechanical/electrical contact. Wireless data transmission is also possible. For example, it is also possible for data to be modulated onto the electric power supply via the programming device in order to write to the storage device.

In accordance with the invention, there is further provided a combination of electrical apparatus and electric power supply connecting device.

Such a combination has the advantages described above. Further, when the electrical apparatus is correspondingly configured, it is also possible to write parameter data stored in the electrical apparatus to the electric power supply connecting device.

In particular, the electric power supply connecting device is detachably connectable to the electrical apparatus. In the event of failure of a corresponding apparatus, a replacement apparatus which is parameterizable "in situ" via the electric power supply connecting device can thereby be provided in a simple manner.

It can be provided that the electrical apparatus comprises a storage device for parameter data in order to enable, for example, the storage of corresponding operating parameters.

It is particularly advantageous for the electrical apparatus to comprise a control device which controls the reading-in and/or storing of parameter data. It is then possible, for example, when initializing the electrical apparatus, to check whether or not the storage device contains parameter data. If no parameter data is contained, then, for example, reading-in of parameter data from the storage device of the electric power supply connecting device can be initiated. In principle, it is also possible, via the control device, to use parameter data of an electrical apparatus in order to write the parameter data into the storage device of a connected electric power supply connecting device.

Advantageously, the control device reads data from the storage device of the electric power supply connecting device and/or from a storage device of the electrical apparatus when the electrical apparatus is being initialized. This ensures that the electrical apparatus receives the correct data during initial startup.

It is possible, by means of the control device, for data to be transmittable from the storage device of the electrical apparatus to the storage device of the electric power supply connecting device. For example, it is thereby possible for the parameter data of an electrical apparatus to be stored in the associated electric power supply connecting device in a simple manner, without having to provide an external programming device. If the electrical apparatus then has to be replaced, the new apparatus receives its parameter data via the electric power supply connecting device.

It is also advantageous for the electrical apparatus to comprise an interface for the data transmission from the electric power supply connecting device in order to enable data to be read in from there.

For the above mentioned reasons it can be advantageous for the interface to be configured for data transmission to the electric power supply connecting device. A "virgin" electric power supply device can thereby be supplied with parameter data directly and locally to the application, i.e. the corresponding electrical apparatus can provide its parameter data to the electric power supply connecting device for the parameter data to be stored there in a non-volatile manner in order to in turn locally maintain the corresponding parameter data externally to the electrical apparatus.

The following description of preferred embodiments serves, in conjunction with the drawings, to explain the invention in greater detail.

DETAILED DESCRIPTION OF THE INVENTION

Figures 1, 2:
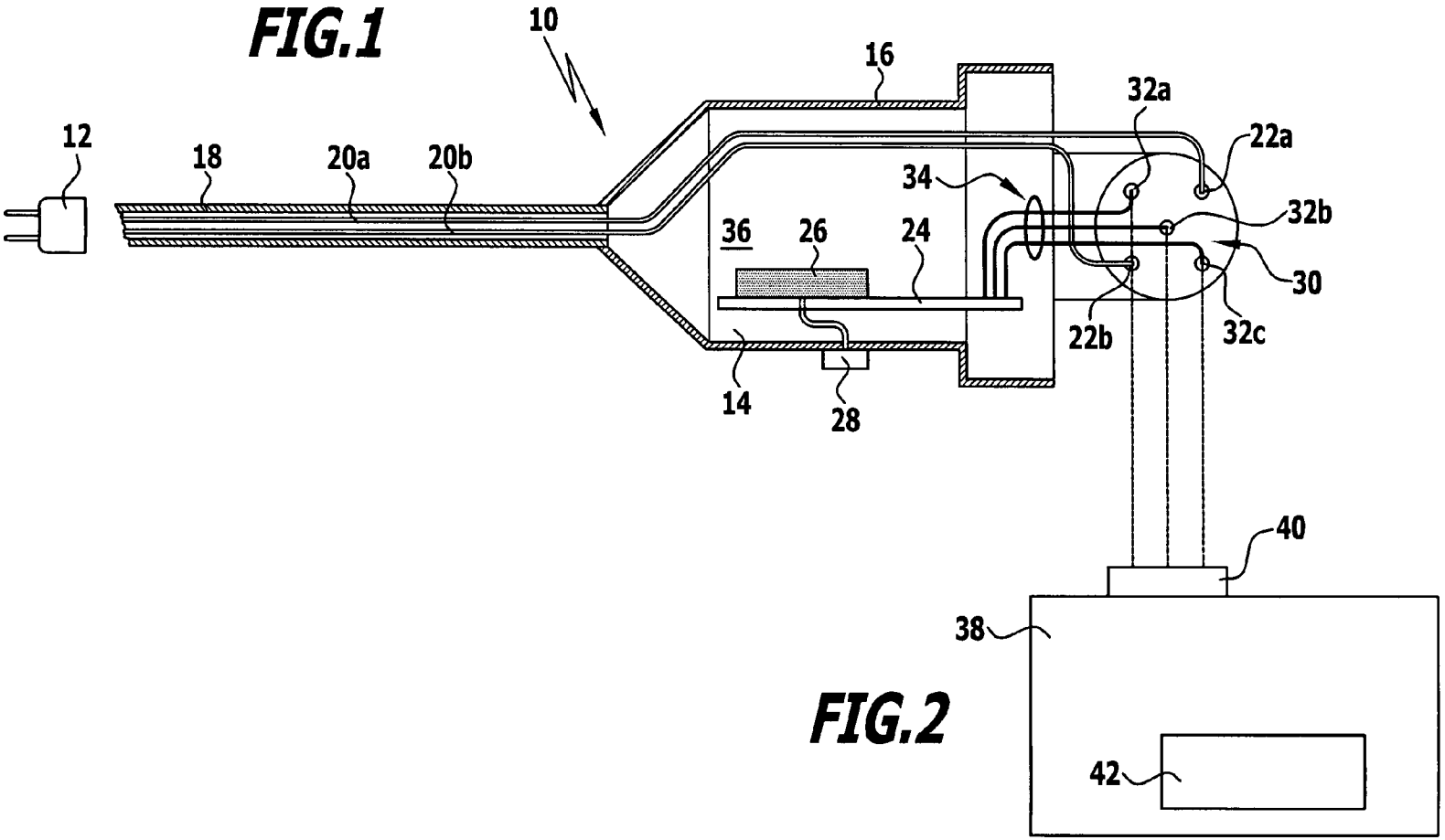
FIG. 1 is a schematic representation of an exemplary embodiment of an electric power supply connecting device in accordance with the invention.
FIG. 2 is a schematic representation of a programming device for the electric power supply connecting device in accordance with FIG. 1.

An exemplary embodiment of an electric power supply connecting device in accordance with the invention, which is shown in FIG. 1 and indicated therein by 10, comprises a first connector 12. This first connector 12 is, for example, formed as or on a plug. Via this connector, the electric power supply connecting device 10 is connectable, for example, to an electric power network such as an industrial low-voltage network (+24 VDC).

Figure 3:
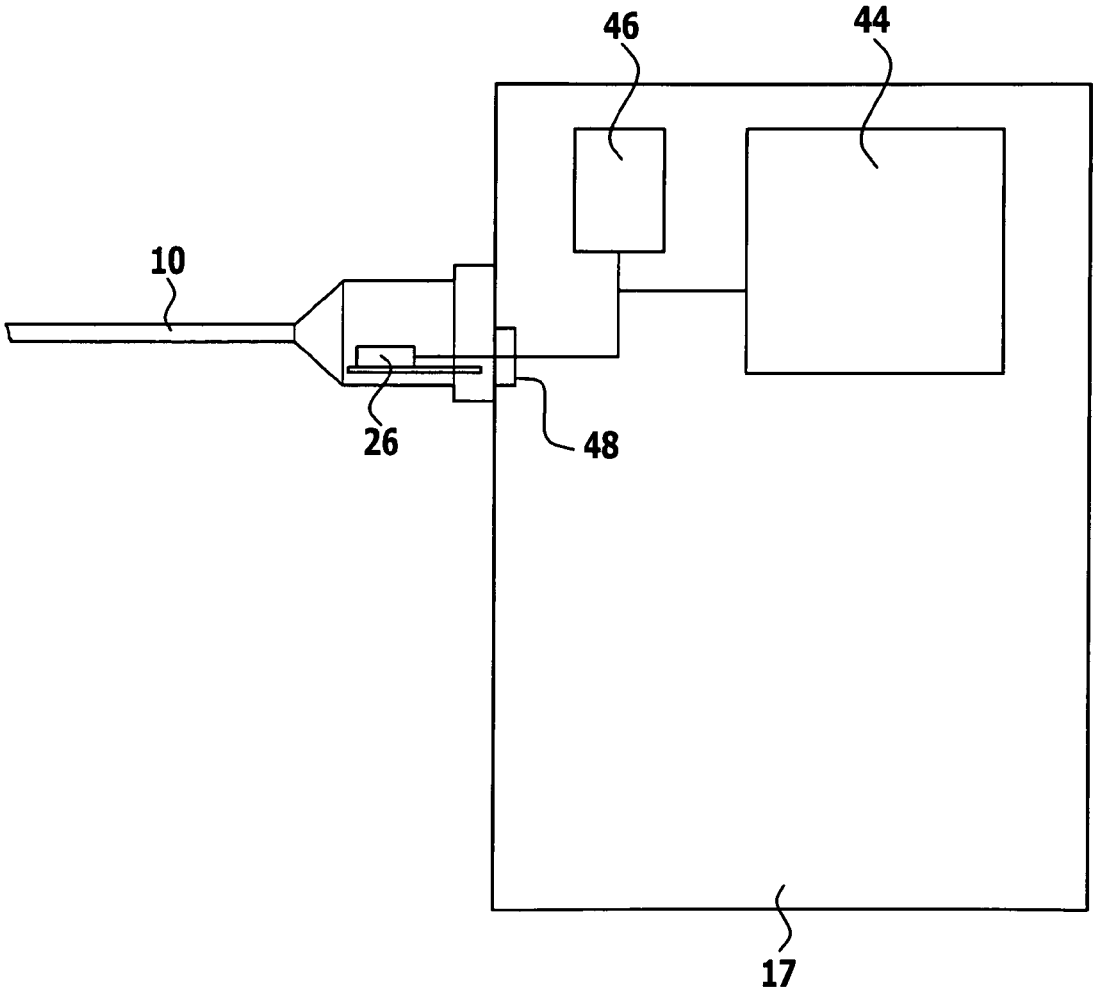
FIG. 3 shows a parameterizable electrical apparatus with the electric power supply connecting device connected.

The electric power supply connecting device 10 further comprises a second connector 14. This second connector 14 is formed, in particular, as or on a plug 16. Via the second connector 14, the electric power supply connecting device 10 is connectable to a (parameterizable) electrical apparatus 17 (FIG. 3).

The first connector 12 and the second connector 14 are connected by a cable 18. In the cable 18, cable conductors 20*a*, 20*b* are routed from the first connector 12 to the second connector 14.

The second connector 14 comprises electric power supply terminals 22*a*, 22*b* which are electroconductively connected to the cable conductors 20*a*, 20*b*, respectively.

The electric power supply connecting device 10 forms a supply cable for the electrical apparatus 17 through which the electrical apparatus 17 is supplied with electrical energy.

A carrier 24, for example in the form of a board, is arranged in the second connector 14. On the carrier 24 is a storage device 26 which holds (at least) one non-volatile memory for data. The memory is configured, for example, as an EEPROM.

It can be provided that the storage device 26 has an indicating device 28 associated with it. The indicating device 28 is, for example, an optical indicating device comprising, in particular, one or more light emitting diodes. By means of the indicating device 28, it can, for example, be indicated whether or not the at least one memory of the storage device 26 contains data.

The electric power supply connecting device 10 comprises a third connector 30 on the plug 16 through which data can be read from the storage device 26 and can be provided to the electrical apparatus 17. The third connector 30 can, in principle, also be used to read data into the storage device 26.

In an embodiment, the third connector 30 is integrated in the second connector 14. Accordingly, the second connector 14 then comprises terminals 32*a*, 32*b*, 32*c* which, upon connection to the electrical apparatus 17, serve in particular the reading out of data from the storage device 26 and the coupling into the electrical apparatus 17.

The electric power supply connecting device 10 comprises an interface 34 on the plug 16 which serves the communication between the storage device 26 and the electrical apparatus 17. The interface 34 is, for example, an I2C interface which enables reading of the storage device 26/writing to the storage device 26.

The storage device 26 is arranged within an interior 36 (cavity) of the plug 16. It is encapsulated in a suitable manner. For example, it is insert-molded.

A programming device 38 (FIG. 2) serves to program the electric power supply connecting device 10, i.e. to write data into the storage device 26. In an embodiment, this programming device 38 comprises a connector 40 which is connectable directly to the third connector 30 by a corresponding mechanical and electrical contact. Via a data field 42 or the like, corresponding data can then be written into the storage device 26 where it is stored in a non-volatile manner.

It is also possible for data to be written wirelessly from the programming device 38 into the storage device 26 when the interface 34 is correspondingly configured. With a corresponding configuration of the interface 34, it is further possible for data to be written into the storage device 26 which is modulated onto the cable conductors 20*a*, 20*b* for electric power supply.

The electrical apparatus 17 is parameterizable. For example, different parameters have to be set for the operation of the apparatus 17. These parameters can be stored locally in the electrical apparatus 17.

The parameters for the electrical apparatus 17 can, for example, also comprise parameters which are characteristic of the location of the electrical apparatus 17 in a network.

Corresponding parameters can, for example, also comprise initializing parameters which ensure that the apparatus is put into the proper operating condition after restarting.

If, in a system comprising several electrical apparatuses, any one of the apparatuses has to be replaced, then the newly employed apparatus has to receive the corresponding parameters. In the solution in accordance with the invention, such an electrical apparatus 17 is provided with the parameters via the—in any case necessary—electric power supply connecting device 10 through which the electrical apparatus is also supplied with electrical energy.

The electrical apparatus 17 comprises a control device 44 which is in operative signal connection with the third connector 30 of the electric power supply connecting device 10. The reading-in of data from the storage device 26 is controllable by means of this control device. For example, the control device 44 controls that data is read in from the storage device 26 of the electric power supply connecting device 10 when initializing the electrical apparatus 17.

The electrical apparatus 17 comprises, in particular, a storage device 46 in which corresponding parameter data is stored. In particular, the storage device 46 is coupled to the control device 44 so that parameter data read out from the storage device 26 is storable in the storage device 46.

In principle, it is also possible for the control device 44 to be used for writing data into the storage device 26 of the electric power supply connecting device 10. The control device thereby causes data to be read out from the storage device 46 and to be written to the storage device 26. For example, a "new" electric power supply connecting device 10 can thereby receive parameter data directly from an electrical apparatus 17 with a non-volatile storage device 46 and can provide this parameter data to a new electrical apparatus later when replacing the electrical apparatus 17.

Correspondingly, the electrical apparatus 17 comprises an interface 48 which is adapted to the interface 34 in order to be able to receive data from the electric power supply connecting device 10 and, if necessary, to send data to the storage device 26.

Loading of the storage device 26 with data or a loaded storage device 26 is indicated, in particular, by the indicating device 28. A user or operator of a system can thereby recognize whether an electric power supply connecting device 10 is "turned on" with respect to data storage.

When initializing an electrical apparatus 17, the control device 44 checks, for example, whether parameter data is stored in the storage device 46. If this is not the case, it provides for data to be read in from the storage device 26 of the electric power supply connecting device 10.

A possible application case for an electrical apparatus 17 is an evaluation unit for an identification system.

The solution in accordance with the invention provides an intelligent electric power supply connecting device 10, for example in the form of a supply cable which is capable of transmitting parameters to an electrical apparatus 17. If the electrical apparatus, in particular in a system, then fails during operation, a replacement apparatus—which does not have to be externally parameterized in a laborious manner, but can take over the parameters from the remaining electric power supply connecting device 10—can be installed in a timely manner. This allows downtimes and hence also downtime costs to be kept low.

Even if a multiplicity of electrical apparatuses is provided in a system, it is possible to carry out a simple and quick parameterizing of "naked" replacement apparatuses because the electric power supply connecting devices 10 in the system are location-specific (based on the required cable routing).

It is thereby possible to perform, virtually in situ, a parameter setting of newly employed electrical apparatuses 17 without the electrical apparatus itself having to be programmed laboriously. The electric power supply connecting device 10 in accordance with the invention permits quick parameterizing of replacement apparatuses.

Further, it is also possible to write the parameters into the electric power supply connecting device 10 in a simple manner. For example, upon restarting an electrical apparatus 17, it is checked whether parameters are already contained within the storage device 46. If this is not the case, then the control device 44 provides for parameters to be read in from the storage device 26 of the electric power supply connecting device 10 and to be written into the storage device 46. The corresponding electrical apparatus 17 can then be put into the proper operating condition.

The control device 44 can, for example, also control a control marker which signals whether, in particular at initial startup, parameters are to be taken over from the storage device 46 and are to be transferred to the storage device 26.

In principle, as mentioned above, it is also possible to provide the storage device 26 with data via a programming device 38 which is independent of an electrical apparatus 17.

The invention claimed is:

1. Combination of an electrical apparatus and an electric power supply connecting device, said electric power supply connecting device comprising:

a first connector for an electric power source;

a second connector adapted to be connectable to and detachable from an electrical apparatus; and a storage device for parameter data which is adapted to be read out by the electrical apparatus; and said electrical apparatus comprising a control device which controls at least one of a reading-in and a storing of the parameter data;

wherein the electrical apparatus and the electric power supply connecting device are separate and independently positionable devices.

2. Combination in accordance with claim 1, wherein the storage device comprises at least one non-volatile memory.

3. Combination in accordance with claim 1, wherein the first connector is comprised by a plug or is formed by a plug.

4. Combination in accordance with claim 1, wherein the second connector is comprised by a plug or is formed by a plug.

5. Combination in accordance with claim 4, wherein the storage device is arranged on the plug.

6. Combination in accordance with claim 1, wherein the storage device is on a carrier and is insert-molded.

7. Combination in accordance with claim 1, further comprising, an interface associated with the storage device for at least one of reading data from the storage device and writing data into the storage device.

8. Combination in accordance with claim 1, wherein a third connector is provided for at least one of reading from and writing to the storage device.

9. Combination in accordance with claim 8, wherein the third connector is integrated in the second connector.

10. Combination in accordance with claim 1, wherein the electric power supply connecting device is formed as an electric power supply cable with at least one connecting plug.

11. Combination in accordance with claim 1, wherein an indicating device is provided which is associated with the storage device.

12. Combination in accordance with claim 1, wherein the electric power supply connecting device is provided for coupling to an electric power network.

13. Combination in accordance with claim 12, wherein the electric power supply connecting device is provided for coupling to a low-voltage power network.

14. Combination in accordance with claim 1, further comprising:

a programming device for writing to the storage device.

15. Combination in accordance with claim 1, wherein the electrical apparatus comprises a storage device for parameter data.

16. Combination in accordance with claim 1, wherein the control device reads data from at least one of the storage device of the electric power supply connecting device and a storage device of the electrical apparatus when the electrical apparatus is being initialized.

17. Combination in accordance with claim 1, wherein data is transmittable from a storage device of the electrical apparatus to the storage device of the electric power supply connecting device by means of the control device.

18. Combination in accordance with claim 1, wherein the electrical apparatus comprises an interface for a data transmission from the electric power supply connecting device.

19. Combination in accordance with claim 18, wherein the interface is configured for the data transmission to the electric power supply connecting device.

* * * * *